United States Patent [19]

Shaw

[11] Patent Number: 4,475,232

[45] Date of Patent: Oct. 2, 1984

[54] FIREMAN'S SAFETY APPARATUS

[75] Inventor: Jon A. Shaw, Overton, Nebr.

[73] Assignee: JAS Electronics, Inc., Overton, Nebr.

[21] Appl. No.: 435,079

[22] Filed: Oct. 18, 1982

[51] Int. Cl.[3] ..... H04R 3/04; H04R 27/00

[52] U.S. Cl. ..... 381/94; 381/56; 381/122

[58] Field of Search ..... 381/94, 122, 56; 328/165

[56] References Cited

U.S. PATENT DOCUMENTS

| | | | |
|---|---|---|---|
| 3,863,027 | 1/1975 | Acks | 179/1 D |
| 3,940,709 | 2/1976 | Heaslett | 330/107 |
| 3,947,636 | 3/1976 | Edgar | 179/1 P |
| 3,971,996 | 7/1976 | Motley et al. | 328/155 |
| 4,044,205 | 8/1977 | Mullarkey | 179/1 P |
| 4,052,560 | 10/1977 | Santmann | 179/1 D |
| 4,122,303 | 10/1978 | Brian et al. | 179/1 P |
| 4,154,981 | 5/1979 | Dewberry et al. | 179/1 P |
| 4,181,818 | 1/1980 | Shenier | 179/1 P |
| 4,185,168 | 1/1980 | Graupe et al. | 179/1 P |
| 4,217,554 | 8/1980 | Brzozowski | 330/124 |
| 4,334,740 | 6/1982 | Wray | 381/94 X |

*Primary Examiner*—G. Z. Rubinson
*Assistant Examiner*—James L. Dwyer
*Attorney, Agent, or Firm*—Schroeder, Siegfried, Vidas & Arrett

[57] ABSTRACT

The disclosure is directed to a steady state signal noise eliminator generally used with fire-fighting equipment including a pair of capacitance and resistance circuits series connected to the input having output signals representative of noise that is phase shifted with respect to the audible signal and is applied to a pair of operational amplifiers connected to the phase-shifting circuits and having their outputs connected to an emitter follower for summing the signals received. A voltage divider is connected to the inputs of the phase-shifting circuits and is connected to a difference amplifier having inputs connected between the voltage divider and an emitter follower to provide an output signal in which only the audible sounds without interference are connected to the output.

8 Claims, 3 Drawing Figures

FIREMAN'S SAFETY APPARATUS

DESCRIPTION

Brief Description of the Invention

This invention relates to the field of communications and more particularly to a steady-state signal noise eliminator.

One of the problems confronting firefighters in hostile fire environments is the creation of certain toxic products of combustion as well as carbon monoxide. Some communities use a safety officer to monitor the breathing and verbal descriptions of a number of interior fire-fighters. That is, these invisible and odorless gases are difficult to detect by any means other than judging the rationality and coherence of the individual who is fighting the fire. Thus, a firefighter may be out of air, disoriented, injured, semi-conscious, or trapped and thus create an audible concern for his own safety. That is, any fireman may transmit their signals on individual UHF frequencies and monitor a separate common channel to which they each may switch their transmission by depressing a momentary switch. While other solutions to the problem have been attempted, an audio squelch circuit still leaves the noise present when the operator is speaking. Additionally, a beat-frequency-oscillator to cancel the constant noise may be used and would be activated by a loss of air, but care is required to not beat the audio or voice signal.

The present invention is directed to a UHF communication system which is particularly adapted for firemen wearing self-contained breathing apparatus. The system serves to continuously transmit information regarding the safety of the firemen to a safety officer as just described. The present invention may be incorporated in the breathing apparatus or to some existing units presently in service wherein the controls are mounted on the regulator of the breathing apparatus and the basic unit is attached to the air tank on the fireman's back. The problem is made more perplexing by the different mode of operation of the breathing apparatus. Thus, where a pressure-demand mode of operation is desired, there is a constant rushing sound of air moving over the microphone. It has been observed that the continuous influx of air into the mask produced a continuous sound of many frequencies. This sound interfered with low-level audio signals from the wearer's voice which is the desired signal that is to be transmitted. It is the solution of this problem for which the present invention is directed. Assuming the continuous noise components to be a series of sine waves of various frequencies, a derivative or first differential of those signals produces a cosine wave. Upon repeating the operation, it is possible to obtain the second derivative which is a negative sine wave. By summing the original sine wave with that of the second derivative, a cancellation of all continuous frequencies is achieved. In other words, the voice having a varying amplitude and frequency remains unaffected and emerges as the true signal.

The same result may be achieved through taking the sine wave and integrating the same to achieve a minus cosine function and repeating the integration to achieve a minus sine function. Upon adding the two signals, the end result obtained is zero. It will also be observed that the conditions set forth for a fireman are also like those of an announcer working in a windy environment. That is, where the wind is passing over the microphone in a steady-state condition, it produces an undesirable background noise or hissing condition.

It is, therefore, a primary object of this invention to provide an improved steady-state noise eliminator.

More specifically, it is an object of this invention to provide a steady-state noise eliminator to be used with a fireman's communication apparatus, a public address system or other communications equipment.

It is yet another object of this invention to provide a circuit using a form of integration circuit or derivative circuit to eliminate steady-state noise signals.

It is still a further object of this invention to provide a circuit that eliminates a steady-state voice signal by adding a double integrated steady-state signal to the input signal.

It is yet another object of this invention to provide a double differentiated electronic circuit that eliminates a steady-state noise signal by adding it to the input signal.

It is still a further object of this invention to provide a double phase-shifting circuit and adding the signal output to the input signal of the circuit.

BRIEF DESCRIPTION OF THE DRAWINGS

A detailed description of the preferred embodiment of my invention is hereafter described with specific reference being made to the drawings in which.

DETAILED DESCRIPTION OF THE INVENTION

Figures 1, 2, 3:
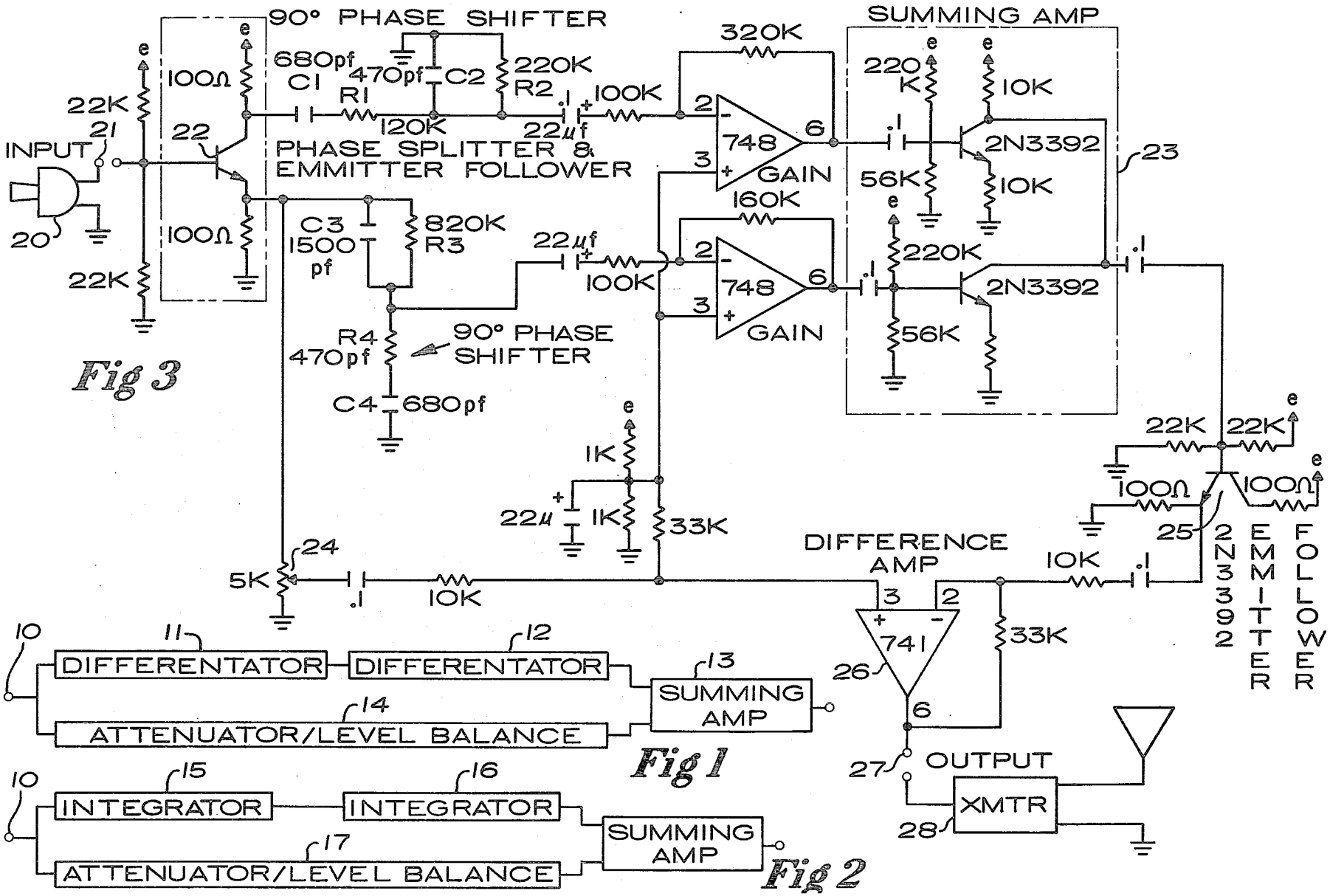
FIG. 1 is a simplified block diagram of the invention disclosing a steady-state noise eliminator using a double differentiator circuit.
FIG. 2 is a simplified block diagram of the invention disclosing a steady-state noise eliminator using a double integrator circuit.
FIG. 3 is a schematic diagram of my invention incorporating a pair of phase-shifting networks.

FIG. 1 discloses an input terminal 10 that has a signal applied thereto that reaches a first differentiator 11. The signal from differentiator 11 is then applied to another differentiator 12 and the output signal is then applied to a summing amplifier 13.

Assume the input signal to be a steady-state sine wave (SIN $\theta$). When the signal is differentiated, it is treated:

$$d(\text{SIN } \theta)=\text{COS } \theta d\theta.$$

The latter signal is the signal that will be obtained after passing through the first differentiator.

The differentiation is repeated a second time and the following takes place:

$$d(\text{COS } \theta)=-\text{SIN } \theta d\theta.$$

The latter signal is the signal that emerges from differentiator 12.

The signal that was received at input 10 then passes through an attenuator/level balance control 14 where the amplitude of the signal is adjusted to be the same as that arriving from the differentiator and that signal is applied to the summing amplifier 13. Thus, the summing amplifier 13 then receives both the input signal and the output signal from differentiator 12 as follows:

$$\text{SIN } \theta+(-\text{SIN } \theta)=\theta.$$

On the other hand, if the first signal received at input 10 is integrated by an integrator 15 (FIG. 2), the signal from integrator 15 may be applied to another integrator 16 and the output of integrator 16 applied to summing amplifier 13. Another attenuator/level balance device 17 will then create the proper amplitude and balancing signal so that again, a steady-state signal is wiped out in summing amplifier 13.

Assume that the input signal may be a steady-state sine wave (SIN $\theta$). By integrating this signal, an output is thus obtained:

$$\text{SIN } \theta d\theta = -\text{COS } \theta.$$

Upon that signal being integrated for the second time, the following is found:

$$-\text{COS } \theta d\theta = -\text{SIN } \theta.$$

The input at terminal 10 is then summed with the output of integrator 16 and the following takes place:

$$\text{SIN } \theta + (-\text{SIN } \theta) = \theta.$$

One circuit tested reduced the undesired input by some 20 db's or better using the resistance-capacitator values set forth. It has been determined that the critical factor in this circuit is a very close matching of amplitude levels of both the phase-shifted and the original signal inputs to the summing amplifiers. For this reason, such may be accomplished by suitable resistance-capacitance networks or with aid of a compensation network. By way of example, R-C network combinations exist which will cause cancellation of the steady-state component or the audio component. The circuit that works the best cancels the audio signal to leave only the steady-state signal. A differential amplifier is then used with the original signal composite to one input and the result of the audio cancellation to the other input leaving a difference of only the audio signal.

A phase-shifting network shown in FIG. 3 includes a microphone 20 that produces a signal at an input terminal 21 wherein the signal is applied to a phase-splitter and emitter follower transistor 22. The output from the collector of transistor 22 is applied through a series capacitance and resistance circuit, C-1 and R-1 to a parallel connection of C-2 and R-2 that has its other end connected to ground. The latter circuit is coupled through a capacitor and resistance network to an operational amplifier LM748, that is a general purpose operational amplifier. The operational amplifier is described in a Linear Integrated Circuits booklet dated Feb. 1, 1975, published by the National Semi-Conductor Corporation, 2900 Semi-Conductor Drive, Santa Clair, Calif. 95051. The output is taken from the LM748 operational amplifier and applied to a summing amplifier that includes a 2N3392 transistor. The collector output of the 2N3392 transistor is coupled to the input of an emitter follower 25, comprising another 2N3392 transistor stage at the output that is used to reduce the output impedance.

Returning to the phase-splitter and emitter follower 22, the emitter output is split, one signal being applied to a voltage divider 24 and the other circuit including capacitance C-3 and resistor R-3 coupled in parallel. The output from the capacitance-resistance circuit is connected through a series connection of resistor R-4 and capacitor C-4 connected to ground. The junction between the two resistance-capacitance networks includes a connection to a second LM748 operational amplifier. The output of the second LM748 operational amplifier is connected to another portion of the summing amplifier that is a 2N3392 transistor. The output from the collector of the last mentioned transistor amplifier is connected to the base of the 2N3392 emitter follower 25. The two operational amplifiers LM748 have their other input connections secured to a mid-supply network that is connected to the supply voltage across a voltage divider.

A difference amplifier 26 is an LM741 operational amplifier. This amplifier may also be found in the Linear Integrated Circuits book published by National Semi-Conductor Corporation.

The positive input on operational amplifier LM741 is taken from voltage divider 24 and applied to operational amplifier 26 while the negative terminal of the operational amplifier is connected to the emitter of the emitter-follower 25 through a capacitance-resistance coupling circuit. The output of the difference amplifier 26 is connected to an output terminal 27. Output terminal 27 is connected to a transmitter 28 to produce the output signal with the characteristics described previously. It has been found that the values of the parameters set forth on the drawings provide a very workable solution to the problem.

In considering this invention, it should be remembered that the present disclosure is illustrative only and the scope of the invention should be determined by the appended claims.

I claim:

1. A steady-state signal noise eliminator to be used with a transducer comprising:

(a) a pair of phase shifting circuits having inputs adapted to receive input signals of noise and audible sounds and providing output signals representative of noise that are phase shifted with respect to said audible signal;

(b) a pair of operational amplifier means, each of which has one of its inputs connected to and driven by, said output signals of said pair of phase shifting circuits and having the other of its inputs connected to a source of voltage;

(c) an emitter follower connected to said pair of operational amplifier means for summing said signals received and providing an output signal thereof;

(d) a voltage divider including a movable contact arm connected to the inputs of said pair of phase shifting circuits having said signals representative of noise and audible sounds deposited across said voltage divider;

(e) and a difference amplifier having its inputs connected between the movable contact arm of said voltage divider and said emitter follower, and having its output providing a signal representative of said audible sounds without interference from signals representative of said noise.

2. A steady-state signal noise eliminator, comprising:

(a) an input terminal constructed and arranged to be connected to a sound transducer providing a signal representative of noise and audible sounds received thereby;

(b) a pair of series connected phase shifting circuits having inputs connected to said input terminal and providing output signals representative of noise that are phase shifted with respect to said audible sounds;

(c) a pair of operational amplifier means each of which has one of its inputs connected to and driven by, said output signals of said pair of phase shifting circuits and having the other of its inputs connected to a source of voltage;

(d) an emitter follower connected to said pair of operational amplifier means for summing said signals received and providing an output signal thereof;

(e) a voltage divider including a movable contact arm connected to said input terminal having said signal representative of noise and audible sounds deposited across said voltage divider;

(f) a difference amplifier having its inputs connected between the movable arm of said voltage divider and said emitter follower, and having its output providing a signal representative of audible sounds without interference from signals representative of said noise, said output constructed and arranged to be connected to a radio transmitter.

3. The structure set forth in claim 2 including:

(g) a phase splitter-emitter follower connected between the outputs of said pair of phase shifting circuits and said input terminal; and (h) a pair of summing amplifiers, each one of which is disposed between said operational amplifier means and said emitter follower connected to said pair of operational amplifier means.

4. The structure set forth in claim 3 wherein each of said pair of phase shifting circuits shifts the electrical phase of the signal received at said input terminal by generally some 90 electrical degrees.

5. The structure set forth in claim 3 wherein said pair of phase shifting circuits has a series connected capacitance and resistance input coupled to one end of a parallel connected capacitance and resistance circuit, and a second pair of series connected phase shifting circuits has a parallel connected capacitance and resistance input coupled to one end of a series connected capacitance and resistance circuit.

6. The structure set forth in claim 5 wherein the electrical phase shift of said first pair of phase shifting circuits is substantially equal to the electrical phase shift of said second pair of series connected phase shifting circuits.

7. The structure set forth in claim 3 wherein each of said pair of phase shifting circuits is a differentiating or integrating circuit shifting the phase angle of the signal received by substantially 180 electrical degrees.

8. The structure set forth in claim 1 wherein the circuits forming each of said pair of phase shifting circuits is series connected.

* * * * *